US008007417B2

(12) United States Patent
Heller

(10) Patent No.: US 8,007,417 B2
(45) Date of Patent: Aug. 30, 2011

(54) EXERCISE DEVICE

(75) Inventor: Alan Heller, New York, NY (US)

(73) Assignee: Ergoergo, Inc., New York, NY (US)

( * ) Notice: Subject to any disclaimer, the term of this patent is extended or adjusted under 35 U.S.C. 154(b) by 0 days.

(21) Appl. No.: 12/387,897

(22) Filed: May 8, 2009

(65) Prior Publication Data

US 2010/0285931 A1 Nov. 11, 2010

Related U.S. Application Data

(63) Continuation-in-part of application No. 12/425,831, filed on Apr. 17, 2009, now abandoned.

(51) Int. Cl.
*A63B 21/008* (2006.01)
*A63B 26/00* (2006.01)

(52) U.S. Cl. ..... 482/112; 482/142

(58) Field of Classification Search ..... 482/51–53, 482/77, 92–96, 111–113, 121–123, 128, 482/133, 135, 140, 142, 148, 131–132; 297/314, 297/325, DIG. 8; 446/197; 248/160, 188.1, 248/548; 188/377–378; 267/117, 199, 122, 267/130–131, 141–142, 153; 273/440, 449–450; 5/255, 413 AM, 614–615, 655.3, 665, 677, 5/682–683, 685–687, 706–707, 710; *A63B 21/008, A63B 26/00*

See application file for complete search history.

(56) References Cited

U.S. PATENT DOCUMENTS

| | | | | |
|---|---|---|---|---|
| 2,350,711 | A | 6/1944 | Amos | |
| 2,878,012 | A * | 3/1959 | Crites | 267/122 |
| 3,029,109 | A * | 4/1962 | Nail | 297/461 |
| 3,261,037 | A * | 7/1966 | Cermak et al. | 267/117 |
| 3,276,048 | A * | 10/1966 | Beckman | 267/119 |
| 3,280,410 | A * | 10/1966 | Propst et al. | 267/119 |
| 3,578,318 | A * | 5/1971 | Young | 472/134 |
| 3,578,381 | A | 5/1971 | Young | |
| 4,191,370 | A * | 3/1980 | Meyer et al. | 482/96 |
| 4,504,989 | A * | 3/1985 | Maltz | 5/655.3 |
| 4,598,946 | A | 7/1986 | Cone | |
| 4,778,216 | A | 10/1988 | Stupakis | |
| 5,060,328 | A * | 10/1991 | Larson | 5/683 |
| 5,441,466 | A | 8/1995 | Piaget et al. | |
| 5,490,711 | A | 2/1996 | Pollock | |
| 5,558,398 | A | 9/1996 | Santos | |
| 6,754,925 | B1 * | 6/2004 | Wang | 5/706 |
| 6,827,401 | B2 | 12/2004 | Marshall et al. | |
| 2002/0019300 | A1 | 2/2002 | Raymond | |
| 2003/0101516 | A1 * | 6/2003 | Hsu et al. | 5/710 |
| 2006/0025226 | A1 | 2/2006 | Nakano et al. | |
| 2008/0182736 | A1 | 7/2008 | Burrell | |

* cited by examiner

FOREIGN PATENT DOCUMENTS

KR 10-0884634 B1 2/2009

*Primary Examiner* — Loan Thanh
*Assistant Examiner* — Oren Ginsberg
(74) *Attorney, Agent, or Firm* — Gottlieb, Rackman & Reisman, P.C.

(57) ABSTRACT

An exercise device for strengthening the core or midsection of the body that is suitable for use in a professional work environment. The exercise device comprises a domed seat positioned atop a plurality of baffled sections. The domed seat is deformable, allowing it to support and conform to the buttocks of a user when sitting on the device. The baffled sections are also deformable, allowing the seat to shift in all directions along a horizontal plane as a user's weight naturally shifts while sitting on the device. As the baffled sections deform and the seat persistently shifts over the course of a given period of time, a user's core muscles repeatedly tense in order to stabilize the body. The constant tension of the muscles over that period of time simulates a workout, particularly in the midsection of the body.

10 Claims, 5 Drawing Sheets

FIG. 1
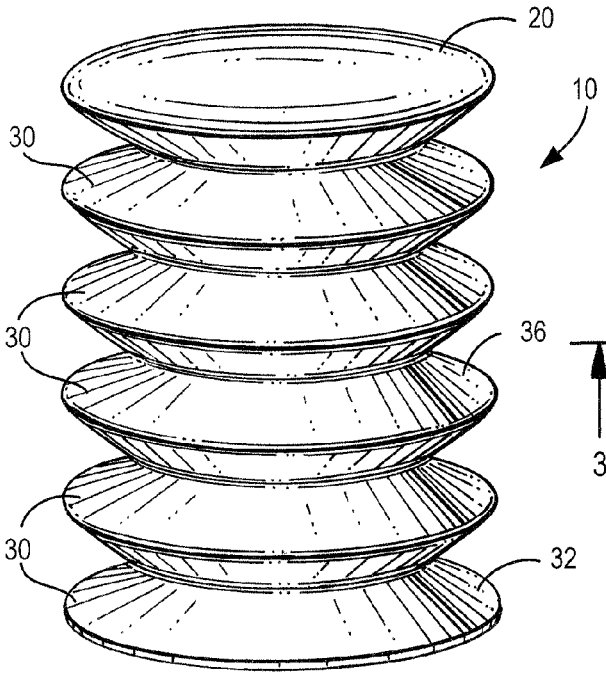
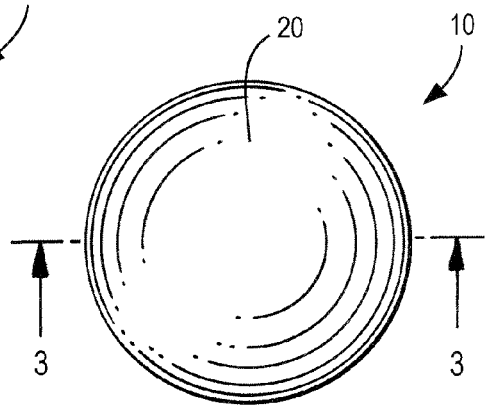
FIG. 2
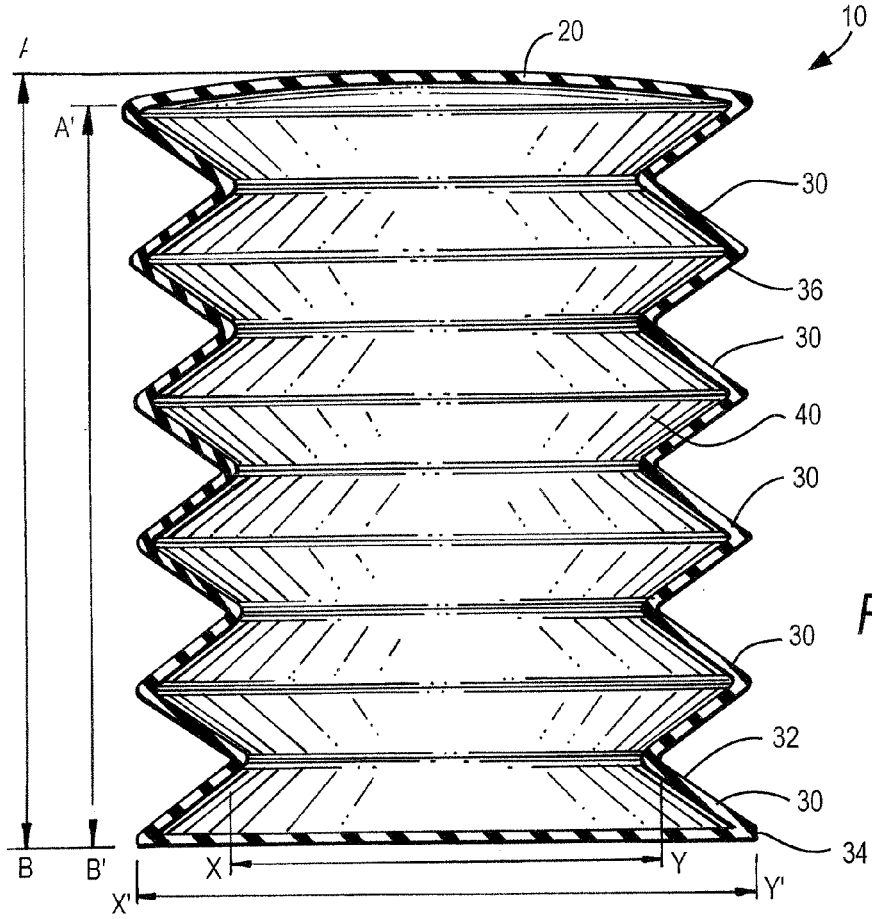
FIG. 3

FIG. 8
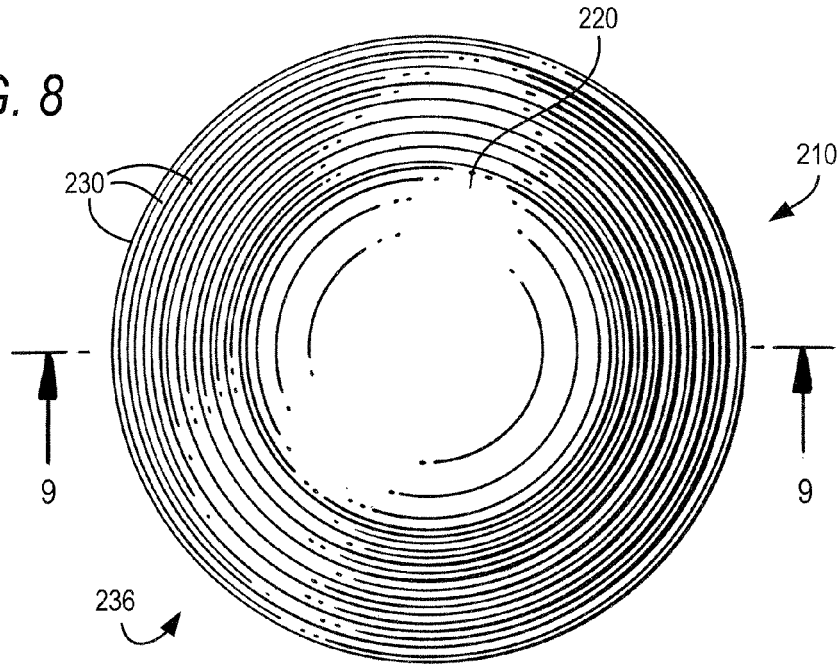
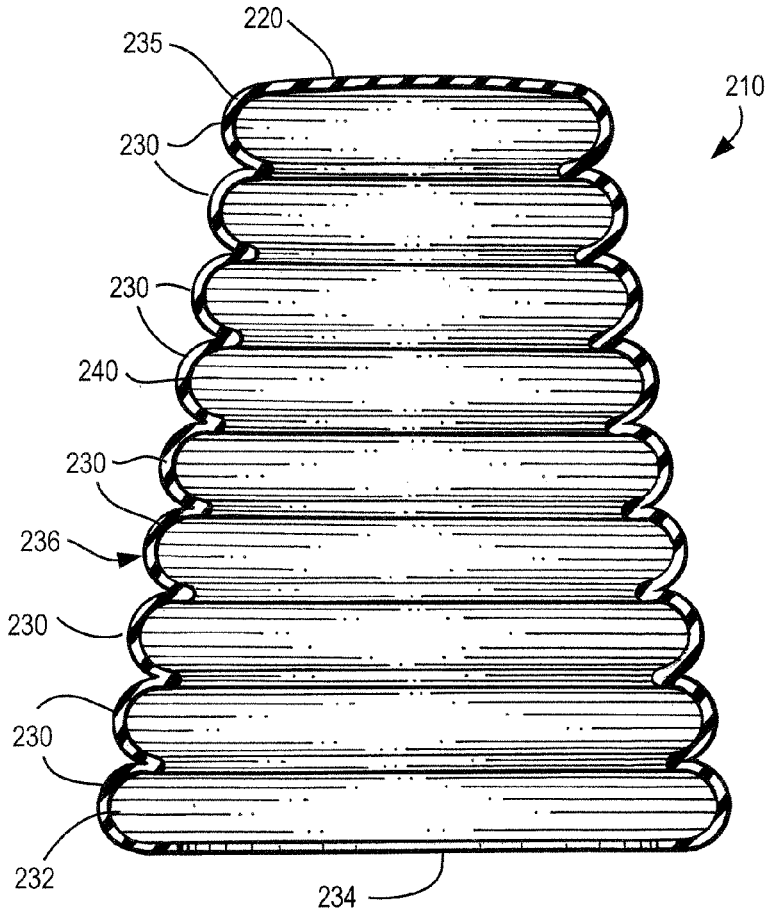
FIG. 9

EXERCISE DEVICE

This application is a continuation-in-part of application Ser. No. 12/425,831 submitted on Apr. 17, 2009 now abandoned.

FIELD OF INVENTION

The present application relates to an exercise device and a method for strengthening muscles. More specifically, the invention relates to an exercise device in the form of a baffled support seat for work or recreational use, such as at an office or home, that encourages strengthening and building of the core muscular groups in the midsection of the body.

BACKGROUND OF THE INVENTION

Chronic back pain is often the product of weak muscles in the back and in core of the body. This problem is typically manifested in those with less active or "couch potato" lifestyles. Because of its debilitating nature, chronic back pain results in increased rates of absenteeism in the Western world.

In those who do not exhibit symptoms associated with chronic back pain, finding time to exercise is sometimes still an unpleasant chore, particularly for those individuals who work. Office personnel, professionals, customer support staff and others who spend most of the work day in the office or at home seated at a desk, totaling in excess of 30 hours a week, are particularly prone to a lack of exercise. This problem is exacerbated in those individuals who are commuters, spending additional time each day in a seated position driving or riding on public transportation. A lack of exercise combined with the inactivity resulting from typical work and commuting environments and schedules often lead to lower overall health, vascular disease and even death.

Even for those who exercise with some degree of regularity, many find that the time devoted to exercise is severely limited, leading to a shortened exercise routine and results that are less than desirable or optimal. Individuals who are conscious of the need to exercise and who make some effort to do so often search for a means to exercise while performing other mundane or relaxing activities, leading to the popularity of certain types of exercise equipment, such as exercise bicycles and treadmills, which can be operated while watching television, reading a book or listening to music.

While some have the time to use and means to afford large exercise equipment, others who work long hours or commute to work may not have the time to work out when they arrive home, and those with limited financial means cannot afford expensive exercise equipment or a gym membership. These issues have led to an increasing demand to make more efficient use of time during the work day, particularly for individuals who work in an office environment and other venues, or who are seated for most of the day and who must, out of necessity, lead a sedentary lifestyle. Similar demands have been made in the context of environments where sitting and waiting are common such as, hospitals, schools, libraries, airports, hotels, spas and the like.

Another obstacle to exercise for those individuals who work in an office environment at home or in the office or who are otherwise seated for most of the day is the type and form of exercise equipment that s available. Specifically, it is less than practical to walk into an office with a full-size exercise bicycle or treadmill, or even with a moderately-sized exercise ball, which is typically utilized to target and strengthen the core muscles of the midsection. Similarly, it would likely not be acceptable to ride a bicycle or walk on a treadmill in the office during the day, or to sit on a "bouncy" exercise ball behind a professional work desk.

SUMMARY OF THE INVENTION

In view of the deficiencies and drawbacks in the prior art, it is a primary object of the present invention to provide an exercise device and method of strengthening muscles, particularly in the midsection of the body, that provides an effective workout over the course of the day.

Another object of the present invention to provide an effective and efficient exercise device and method of strengthening muscles to be utilized by office personnel, professionals, customer support staff and others who spend most of the work day seated at a desk or seated at other locations.

Still another object of the present invention is to provide an exercise device and method of strengthening muscles that overcomes issues associated with workers who do not have the time to work out when they arrive home, and/or those with limited financial means.

A further objective of the present invention is to provide an exercise device and method of strengthening muscles that is compact and fit for use in an office, at home, at a professional work environment or other suitable venues.

Other objectives of the present invention is to provide an exercise device that helps promote good and upright posture, burn calories, and that develops muscles that have declined in activity and function over a period of time, particularly in the back, thereby reducing the incidence of chronic back pain.

Additional objectives will be apparent from the description of the invention that follows.

In summary, there is provided in a preferred embodiment of the present invention an exercise device and method of strengthening muscles, particularly in the core or midsection of the body. The exercise device comprises a domed seat positioned atop a plurality of baffled sections, the lowest baffled section preferably terminating in a flat wall. The exercise device is preferably formed of a thermoplastic material through a conventional molding process, such as blow molding. The domed seat is deformable, allowing it to support and conform to the buttocks of a user when sitting on the device. The baffled sections are also deformable, allowing the seat to shift in all directions along a horizontal plane (e.g., side to side, front to back, etc.) as a user's weight naturally shifts while sitting on the device. As the baffled sections deform and the seat constantly shifts over the course of a given period of time, a user's core muscles repeatedly tense in order to stabilize the body. The constant tension of the muscles over that period of time and intermittent changes of position simulates a workout, particularly in the midsection of the body.

BRIEF DESCRIPTION OF THE DRAWINGS

The above-described and other advantages and features of the present disclosure will be appreciated and understood by those skilled in the art from the following detailed description and drawings of which FIG. 1 is a front elevational view of a first preferred embodiment of a baffled exercise device made in accordance with the present invention;

FIG. 2 is a top view of the baffled exercise device of FIG. 1;

FIG. 3 is a cross sectional view of the baffled exercise device taken along line 3-3 of FIG. 2;

FIG. 8 is a top view of a third preferred embodiment of a baffled exercise device with rounded baffles and a conical configuration; and FIG. 9 is a cross sectional view of the baffled exercise device taken along lines 9-9 of FIG. 8.

DETAILED DESCRIPTION OF THE INVENTION

Figure 1A:
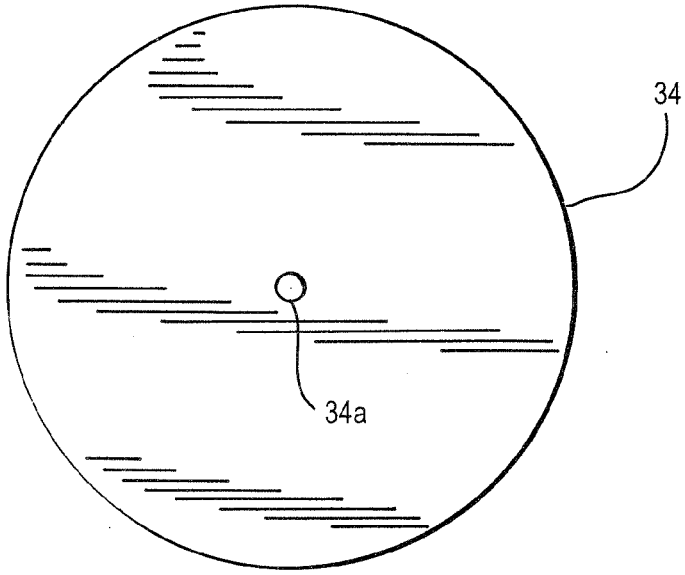
FIG. 1A shows a removable plug on the bottom wall of the device.

With reference to FIGS. 1 through 5, there is shown a preferred embodiment of an exercise device 10 of the present invention. The exercise device 10 comprises a seat 20 positioned atop a plurality of sections 30 that outwardly appear to be stacked upon one another, yielding a height dimension of the exercise device 10, measured from A to B (as shown in FIG. 3). The lowermost section 32 that is in contact with the floor terminates in a platform or substantially flat wall 34. Generally, it should be understood that the lowermost section 32 (in both this embodiment and in alternate embodiments) can also serve as a base to support the exercise device 10 on the ground. The plurality of sections 30 together forms a non-uniform, baffled wall 36. Preferably, the diameters of the seat 20 and bottom wall 34 are 14 inches to 16 inches. The overall height and width dimensions are conducive to a professional work environment at home or in the office, behind a desk or the like, in contrast to conventional exercise equipment that is inappropriate for office use.

Figure 5:
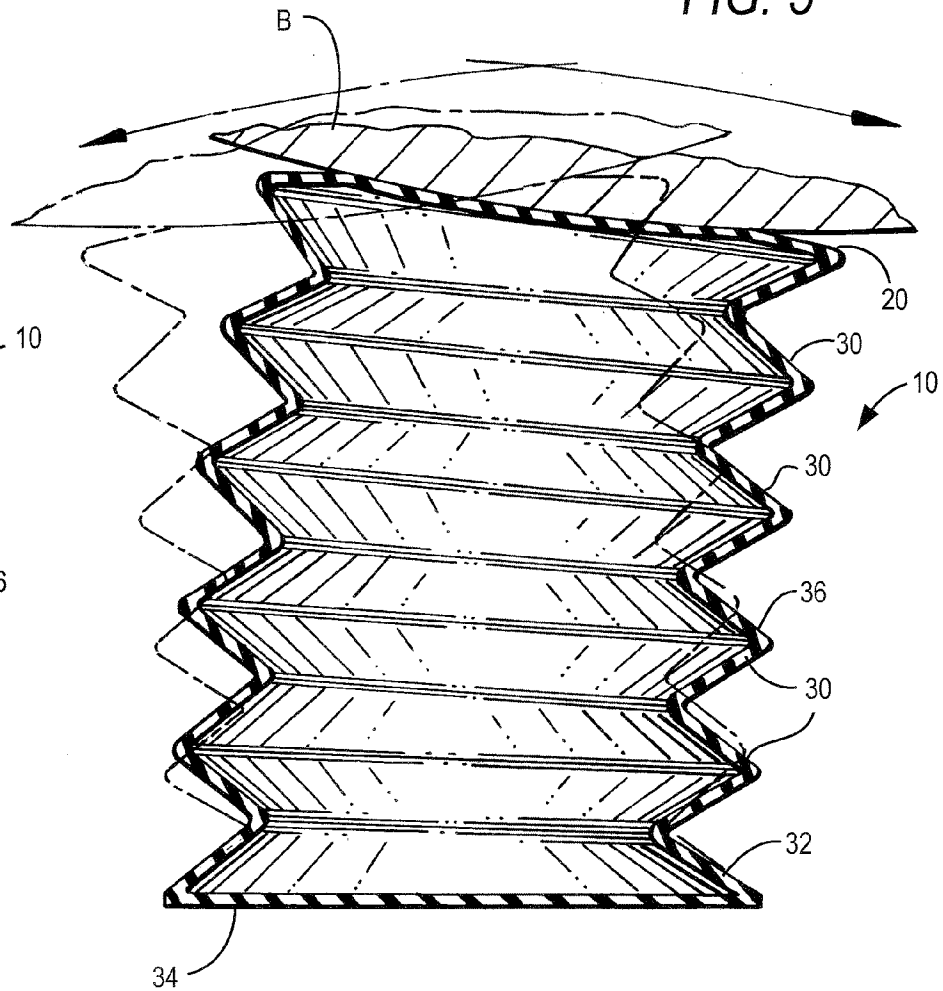
FIG. 5 is a cross sectional view of the baffled exercise device with a user shifting positions while sitting on the device, showing symbolically a portion of a user's buttocks.
Figure 4:
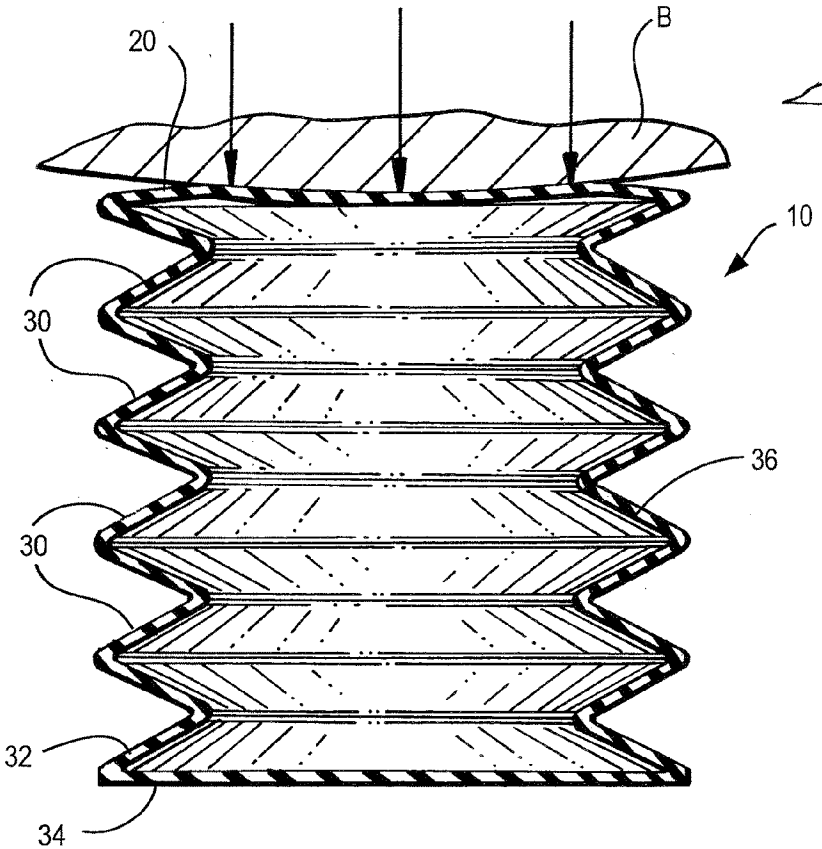
FIG. 4 is a cross sectional view of the baffled exercise device with a user sitting on the device, showing symbolically a portion of a user's buttocks.

The seat 20 is preferably deformable, as shown in FIG. 4 and FIG. 5, allowing it to support and generally conform to the buttocks B of a user. The seat 20 is preferably 4 mm thick. The sections 30 are also deformable, as shown in FIG. 4 and FIG. 5, allowing the seat 20 to shift and move relative to the rest of the device 10, while the lowermost section 32 remains in place, in constant contact with the ground. Over time, as the seat 20 shifts, as shown in FIG. 5, a user's core muscles repeatedly tense in order to stabilize the body, thereby simulating a workout. The continuous movement expends calories to promote weight loss. Over the course of a day, and over greater periods of time, the results can be beneficial and substantial, particularly, at the midsection of the body.

Each of the sections 30 has an angular, baffled configuration, such that the sections each have a maximum width dimension, measured from X to Y, that is equal to one another. Similarly, the sections each have a minimum width dimension, measured from X' to Y', that is equal to one another.

The exercise device 10 according to the present invention is formed of a thermoplastic material through a conventional molding process, such as blow molding. One of the types of thermoplastic material that is used in the formation of the exercise device 10 is a high-density polyethylene (HDPE) which is significantly harder and has more tensile strength than ordinary polyethylene. Other types of conventional materials which are known in the art and which can be utilized in the formation of the exercise device 10 include a combination of HDPE and a mixture of flexible thermoplastic polyurethane (TPU) resin, or a combination of polyethylene and elastomer. Preferably, the plastics used in connection with the formation of the exercise device 10—particularly the seat 20—have a relatively lower frictional coefficient for reasons discussed below.

The exercise device 10 comprises a hollow interior area 40. The hollow interior 40 has an internal, lateral configuration that corresponds to or complements the external baffled configuration of the exercise device 10. Preferably, the exercise device 10 is constructed so that the interior is airtight. Where the seat 20 and baffled wall 36 are integrally molded, a conventional airtight seal can be positioned between the baffled wall 36 and flat wall 34. The baffled wall 36 of the device 10 is approximately 4 mm inches thick. While different degrees of thickness and materials may be employed, the thickness of the wall 36, combined with the particular material(s) used in the formation of the wall 36 can be modified and controlled to allow the exercise device to be flexible enough to deform and shift when a user sits on the device 10, yet maintain a generally rigid and angular configuration. In that regard, it is desirable for there to be sufficient movement that can be controlled through the use of the core muscles in the midsection of the body, but not too much movement which would cause more than moderate strain of the core muscles in the midsection of the body consistent with a normal exercise routine.

With the foregoing precepts in mind, it should be understood that the illustration of FIG. 4 is somewhat exaggerated to accentuate the difference in the appearance of the device 10 when it is isolated (i.e., without someone seated on the device 10), as shown in FIG. 3, versus its appearance when a user is seated on the device 10, as shown in FIG. 4. In particular, the height dimension of the exercise device 10 when it is isolated, measured from A to B, is typically 21 inches. In contrast, the height dimension of the exercise device 20 when a user is seated, measured from A' to B', has a modest 1-2 inch (or 5%-10%) reduction in overall height of the exercise device. Notably, it should be understood that the reduction in height is primarily the result of the compression of the seat 20, rather than the collapsing of the baffled wall 36. Of course, it is possible to alter the materials used in the formation of the wall and/or seat, and/or to change the degree of thickness of the wall and/or seat, to produce greater or lesser degrees of compression as desired.

Similarly, the illustration of FIG. 5 is somewhat exaggerated to accentuate that the device 10 is capable of shifting in all directions along a horizontal plane (e.g., side to side, front to back, diagonally, etc.) as a user's weight naturally shifts while sitting on the device 10. However, it should be appreciated that, in the preferred embodiment, the movement of the seat in any direction is only about 1-2 inches. Of course, it is possible to alter the configuration, the materials used in the formation of the wall and/or to change the degree of thickness of the wall to produce more or less movement in any direction as desired.

Rather than make the device airtight as molded, it is optional to provide, as shown in FIG. 1A, a small plug 34*a* which fits functionally into a small opening in the flat wall 34, permitting seating. In this manner, the device may be slightly depressed and then sealed by plug 34*a*, yielding somewhat more flexibility in the unit. Further, a small ledge 36*a*, as shown in FIG. 1C, may be provided to give the bottom portion slightly more stability.

Figure 1B:
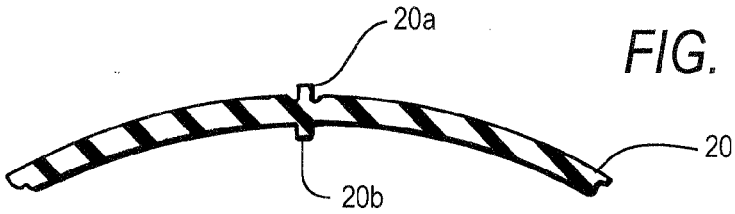
FIG. 1B shows a raised parting line on the exterior of the dome of the device, and a parallel interior ledge on the interior surface of the dome.
Figure 1C:
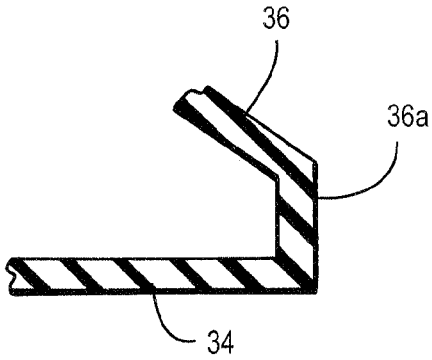
FIG. 1C shows a small bottom portion of the cross-sectional view of the device showing a small ledge.

Also, the top dome, see FIG. 1B, may include a top parting line 20*a*, and an internal parallel ledge 20*b*, both of which run along the diameter of the seat, to yield an orientation for deflection of the dome, which may be utilized by a user.

As shown in FIG. 4 and FIG. 5, the seat 20 is deformable such that the seat 20 compresses modestly when a user initially sits on the device 10. By allowing for only minimal compression of the seat 20, a user feels comfortable while sitting on the exercise device 10, but must use and tense more of the abdominal or core muscles to achieve effective stabilization, as opposed to relying exclusively on the friction between the seat 20 and the user's clothing, and a more concave surface for stabilization. Using material(s) with a relatively lower frictional coefficient in the formation of the seat 20 also encourages the utilization of the abdominal or core muscles to achieve effective stabilization.

Since excess depression of the height of the seat may result in less than desirable tension in the abdominal area during use of the device 10, the seat 20 preferably has dimensions and a restricted range of flexibility that limits the depression of the seat 20 so that the depression of the seat (not including the potential depression caused by partial collapsing of the wall) cannot exceed approximately 2 inches, without regard to a progressive increase in the weight load placed on the seat 20. This feature ensures that different users of varying weights can achieve at least a minimum level of activity in the core area.

Figure 6:
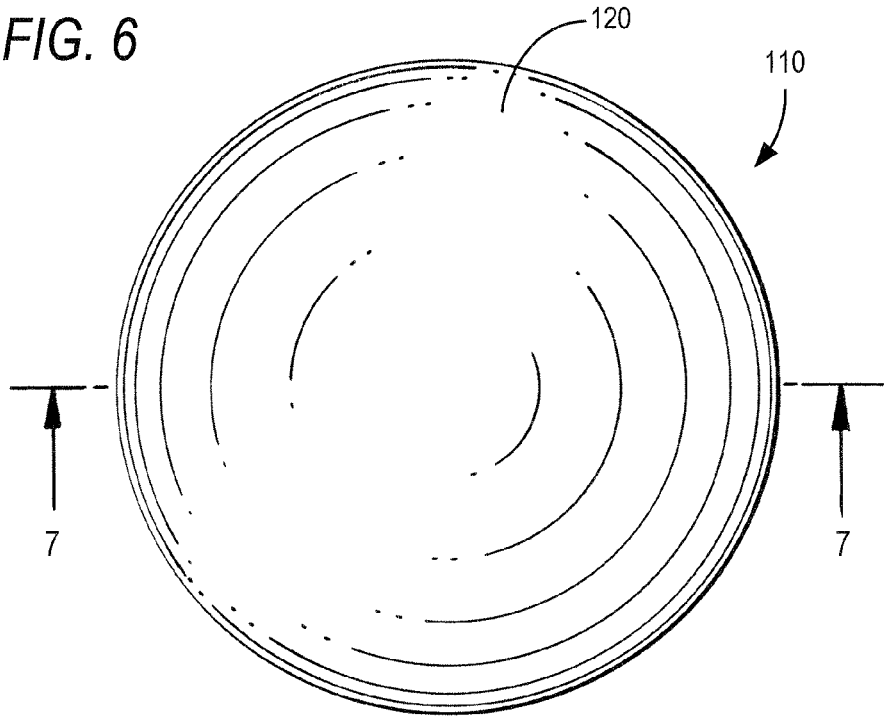
FIG. 6 is a top view of a second preferred embodiment of a baffled exercise device with rounded baffles and an asymmetrical hourglass configuration.
Figure 7:
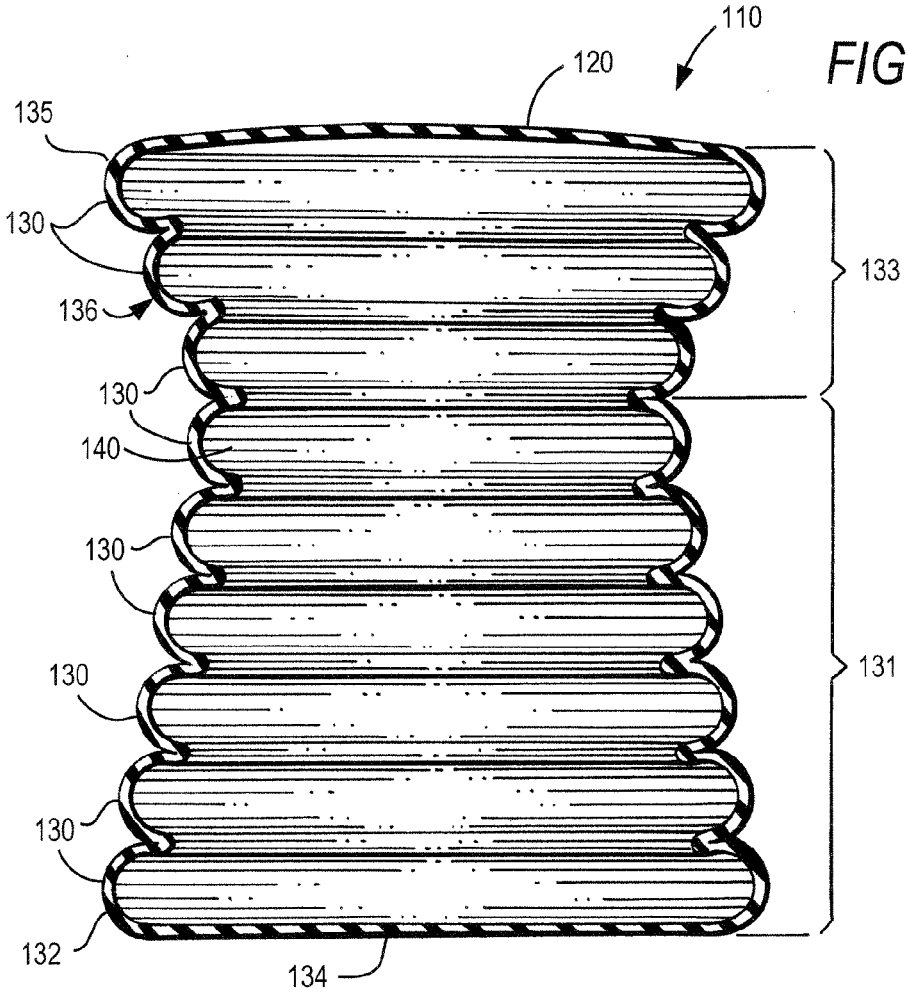
FIG. 7 is a cross sectional view of the baffled exercise device taken along line 7-7 of FIG. 6.

Another preferred embodiment of the exercise device 110 is illustrated in FIG. 6 and FIG. 7. In this embodiment, the exercise device 110 incorporates a series of sections 130 with a rounded baffled wall 136, instead of the angularly configured wall 36 of the preceding embodiment. The bottom of the exercise device 110 terminates in a platform or substantially flat wall 134. In this embodiment, the sections 130 and wall 136 form an asymmetrical hourglass configuration having a hollow interior 140, whereby (proceeding from top to bottom) sections 130 each have a maximum width dimension that becomes progressively smaller, and then progressively larger. Similarly, the sections 130 each have a minimum width dimension that becomes progressively smaller, and then progressively larger. Preferably, the lower segment 131 measures twice the height of the upper segment 133 resulting in a 2:1 ratio. In addition, the uppermost section 135 preferably has the same diameter as the lowest section 132, in the range of 14 inches to 18 inches, and most preferably 16 inches. The height dimension of the exercise device 110 is preferably 20 inches to 22 inches, with depression ranges preferably in the area of 1 inch to 2 inches or 5% to 10% of the total height.

Rounded sections 130 are particularly beneficial for providing additional support in the hourglass configuration in that there is less space or a smaller gap between sections 130 as compared to the spaces or gaps between sections 30. The rounded sections 130 further inhibit the undesirable collapse of the wall 136 and/or excessive shifting of the seat 120 in the event that too much weight is shifted in a particular direction.

A third preferred embodiment of the exercise device 210 is illustrated in FIG. 8 and FIG. 9. In this embodiment, the exercise device 210 also incorporates a seat 220 and a series of sections 230 with rounded baffled walls 236, instead of the angularly configured wall 36 of the first embodiment. The bottom of the exercise device 210 terminates in a platform or substantially flat wall 234. In this embodiment, the sections 230 and wall 236 form a generally conical configuration having a hollow interior 240, whereby (proceeding from the uppermost section 235 to the lowest section 232) sections 230 each have a maximum width dimension that becomes progressively larger. Similarly, the sections 230 each have a minimum width dimension that becomes progressively larger. In addition, the uppermost section 235 preferably has a diameter in the range of 14 inches to 17 inches, and is most preferably either 14 inches or 17 inches. The lowest section 232 has a diameter in the range of 14 inches to 18 inches, and most preferably 16 inches. The height dimension of the exercise device 210 is preferably 20 inches to 22 inches, with depression ranges preferably in the area of 1 inch to 2 inches or 5% to 10% of the total height.

In each of the foregoing embodiments, it should be understood that the height of each individual section 30, 130, 230 can be increased or decreased as desired. Similarly, it should be appreciated that such increases or decreases in the height of each individual section 30, 130, 230 need not be uniform, and can be disproportionate if desired. So while a section 30 typically comprises a height of about 4 inches, it can be appreciated that the height of any one section can be altered as desired to provide additional stability or flexibility to the apparatus.

It should also be understood that the exercise device of the present invention may be modified to conform to the heights and muscular capabilities of children. The exercised device may be used in an educational setting where it may promote concentration in children. In such and embodiment the exercise device would range in height from 14 to 17 inches.

The accompanying drawings illustrate a series of embodiments of a particular exercise device. It should be appreciated that other types, styles and configurations are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the certain terms may be used herein to modify various elements. These modifiers do not imply a spatial, sequential, or hierarchical order to the modified elements unless specifically stated.

The invention claimed is:

1. An exercise device for strengthening muscles of a user in a conventional work, home or other environment, comprising:

(a) a plurality of deformable sections, including an uppermost section and a lowermost section, said plurality of sections forming a continuous baffled wall;

(b) a deformable domed seat positioned atop said uppermost section, said domed seat adapted to conform to the buttocks of a user when said user sits on said seat;

(c) a distance between said domed seat and said lowermost section is greater than a distance between opposing sides of said baffled wall;

(d) said lowermost section being substantially flat and said continuous baffled wall, said domed seat and said lowermost section together enclosing an airtight hollow interior, said interior constituting a single, continuous space extending from said domed seat to said lowermost section;

(e) said domed seat being adapted to depress within said hollow interior;

(f) said baffled wall having a sufficiently small thickness to enable said domed seat and uppermost section to shift in all directions horizontally while said lowermost section remains substantially in place as a user sits on the device and shifts position;

(g) the material forming the domed seat and the deformable sections being a plastic and having sufficient thickness such that the device is generally rigid so as to be able to take the positions set forth in (e) and (f) above.

2. The exercise device of claim 1, wherein said baffled wall has an angular configuration.

3. The exercise device of claim 1, wherein each of said plurality of deformable sections has a maximum width dimension that is equal to one another.

4. The exercise device of claim 1, wherein each of said plurality of deformable sections has a minimum width dimension that is equal to one another.

5. The exercise device of claim 1, wherein said uppermost section and said lowermost section each have the same diameter.

6. The exercise device of claim 1, said deformable seat adapted to be depressed 1 inch to 2 inches when said user sits on said seat.

7. The exercise device of claim 1, said device having a total height dimension, and said deformable seat adapted to be depressed in the range of 5% to 10% of said total height of said device when said user sits on said seat.

8. The exercise device of claim 1, said device having a total height dimension, and said deformable seat adapted to be depressed in the range of 5% to 10% of said total height of said device when said user sits on said seat.

9. An exercise device for strengthening abdominal muscles of a user in a conventional work or home environment, comprising:

(a) a deformable baffled wall having a top and a bottom;

(b) a base at said bottom of said baffled wall;

a domed seat formed of a thermoplastic material positioned at said top of said baffled wall, said domed seat adapted to depress within said hollow interior and to conform to the buttocks of a user when said user sits on said seat; said seat, said baffled wall and said base together enclosing an airtight hollow interior, said interior constituting a single, continuous space extending from said domed seat to said bottom of said baffled wall; a distance between said domed seat and said bottom of said baffled wall is greater than a distance between opposing sides of said baffled wall;

(c) wherein said domed seat has a sufficient thickness and said hollow interior is sufficiently airtight to prevent said domed seat from depressing more than two inches within said hollow interior; and (d) wherein said baffled wall has a thickness dimension small enough to enable said baffled wall and said domed seat to shift in all directions along a horizontal plane, and said lowermost section to remain substantially in place, when said user sits on said device and shifts position.

10. The exercise device of claim 9, wherein said baffled wall is formed of a plurality of sections, each of said sections having an angular configuration.

* * * * *